US005807132A

United States Patent [19]

Okabe

[11] Patent Number: 5,807,132

[45] Date of Patent: Sep. 15, 1998

[54] PRESS-CONNECTING CONNECTOR

[75] Inventor: Toshiaki Okabe, Shizuoka, Japan

[73] Assignee: Yazaki Corporation, Tokyo, Japan

[21] Appl. No.: 760,763

[22] Filed: Dec. 5, 1996

[30] Foreign Application Priority Data

Dec. 5, 1995 [JP] Japan ..... 7-316760

[51] Int. Cl.[6] ..... H01R 4/24

[52] U.S. Cl. ..... 439/399

[58] Field of Search ..... 439/387, 889, 439/391, 395, 404, 399, 398, 407, 867

[56] References Cited

U.S. PATENT DOCUMENTS

| | | | |
|---|---|---|---|
| 4,441,779 | 4/1984 | Foederer et al. | 439/404 OR |
| 4,693,536 | 9/1987 | Colleran et al. | 439/404 OR |
| 5,122,077 | 6/1992 | Maejima et al. | 439/404 X |

*Primary Examiner*—P. Austin Bradley
*Assistant Examiner*—Daniel Wittels
*Attorney, Agent, or Firm*—Sughrue, Mion, Zinn, Macpeak & Seas, PLLC

[57] ABSTRACT

A press-connecting connector in which terminals are mounted respectively in terminal receiving chambers of a housing, and a wire is pressed-connected to each of the terminals borne by a bottom plate portion of the terminal receiving chambers. A main portion of the bottom plate portion is defined by a reduced-thickness portion, and a rear end portion of the bottom plate portion is defined by a thickened portion larger in thickness than the reduced-thickness portion. Preferably, the reduced-thickness portion is continuous with the thickened portion through a step portion, and each of the terminals includes a press-connecting portion, and clamping piece portions which are continuous with the press-connecting portion through a base plate portion, and also the base plate portion has a bent portion which conforms to the step portion.

4 Claims, 2 Drawing Sheets

PRESS-CONNECTING CONNECTOR

BACKGROUND OF THE INVENTION

1. Field of the Invention

This invention relates to a press-connecting connector in which a wire is press-connected by a jig (or tool) to each terminal mounted in a housing.

2. Description of the Related Art

There is known a press-connecting connector of the type in which a sheathed wire is press-fitted into each press-connecting terminal having a press-connecting blade, so that a sheath of the wire is cut by the press-connecting blade, thereby electrically connecting a conductor of the wire to the press-connecting blade. In a conventional press-connecting connector, terminals are mounted in a connector housing as shown in FIG. 3. The housing 1 includes a pair of side plate portions 3, a bottom plate portion 5 interconnecting the pair of side plate portions 3, and juxtaposed terminal receiving chambers 9 which are formed on each of upper and lower surfaces of the bottom plate portion 5, and are separated from one another by a plurality of parallel partition walls 7.

The housing 1 has an open portion 11 through which rear portions of the terminal receiving chambers 9 are exposed. A terminal (not shown) is mounted in each terminal receiving chamber 9, with a press-connecting portion (having a press-connecting blade) received in the open portion 11. In the press-connecting connector, a wire is press-fitted into each terminal thus mounted in the housing 1. More specifically, a wire, arranged in the open portion 11, is press-fitted into the press-connecting blade of the terminal by a press-connecting jig or tool (not shown), so that an insulating sheath of the wire is cut by the press-connecting blade, thereby electrically connecting a conductor of the wire to the press-connecting blade, thus press-connecting the wire to the terminal. At the same time, a pair of clamping piece portions, formed, for example, a t a rear end portion of the terminal, are clamped around the wire by a jig.

However, in the above conventional press-connecting connector in which a row of terminals are arranged on each of the upper and lower surfaces of the bottom plate portion 5, if the thickness of the bottom plate portion 5 is reduced in order to reduce the size of the connector i n a direction of the thickness of the bottom plate portion 5, the bottom plate portion 5 is deformed by a pressing force applied by a jig 13 during the press-connecting of the wire as shown in FIG. 4, and the press-connecting position of the wires, as well as the clamped state of the wires by clamping piece portions, is varied, resulting in a problem that a stable quality can not be achieved. The small-size design and the strength of the bottom plate portion 5 are contrary to each other, and if the sufficient strength is secured, the small-size design can not be achieved, and in contrast if the small-size design is achieved, the strength is reduced. Although the row of terminals are arranged on each of the upper and lower surfaces of the bottom plate portion 5 in the above conventional construction, the above problem has also been encountered with the type of press-connecting connector in which terminal receiving chambers 9 are formed only on one side of the bottom plate portion 5.

SUMMARY OF THE INVENTION

With the above problem in view, it is an object of the present invention to provide a press-connecting connector which can be reduced in size in a direction of a thickness of a bottom plate portion while eliminating the possibility of deformation of a housing, thus achieving a small-size design and a stable quality.

In order to accomplish the above object, the invention provides a press-connecting connector: a housing; a terminal receiving chamber formed in the housing; and a terminal, mounted in the terminal receiving chamber and borne by a bottom plate portion of the terminal receiving chamber, to which a wire is to be pressed-connected, wherein one portion of the bottom plate portion is defined by a reduced-thickness portion, and the other portion of the bottom plate portion is defined by a thickened portion larger in thickness than the reduced-thickness portion.

DETAILED DESCRIPTION OF THE PREFERRED EMBODIMENT

A preferred embodiment of a press-connecting connector of the present invention will now be described in detail with reference to the drawings.

Figure 1:
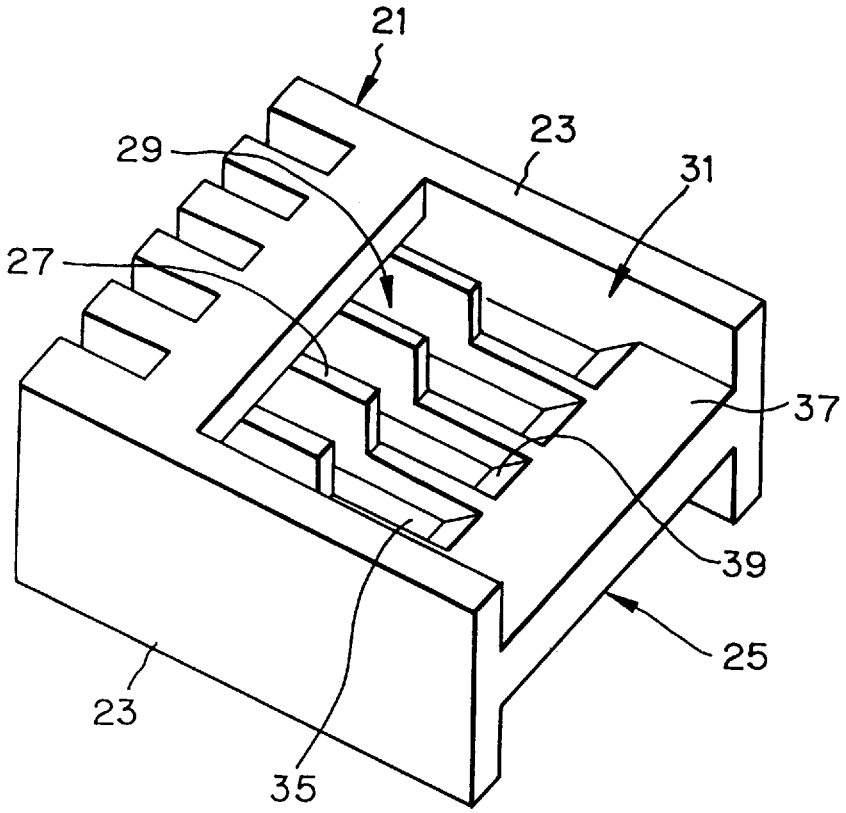
FIG. 1 is a perspective view showing a housing of a press-connecting connector of the present invention.
Figure 2:
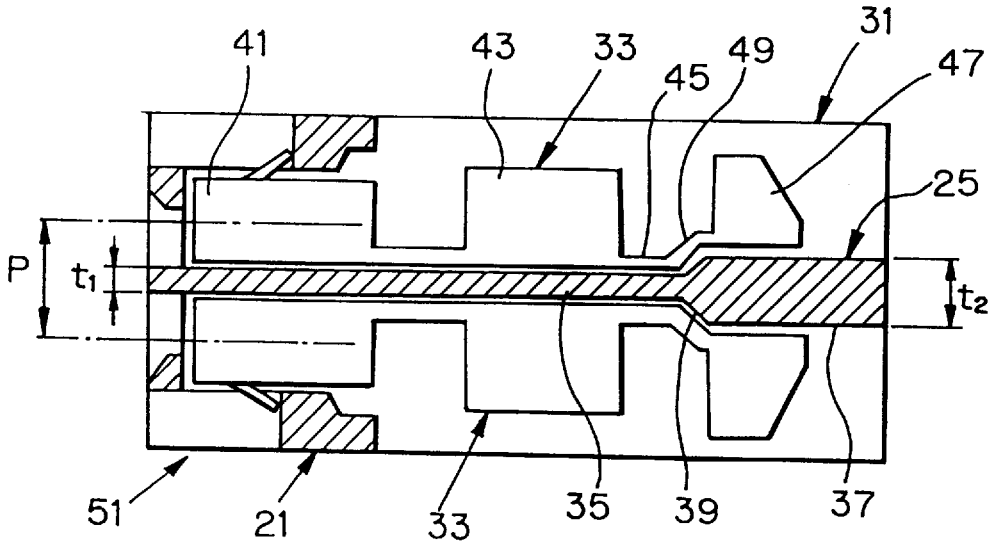
FIG. 2 is a vertical cross-sectional view of the press-connecting connector of the invention having terminals mounted in the housing.
Figure 3:
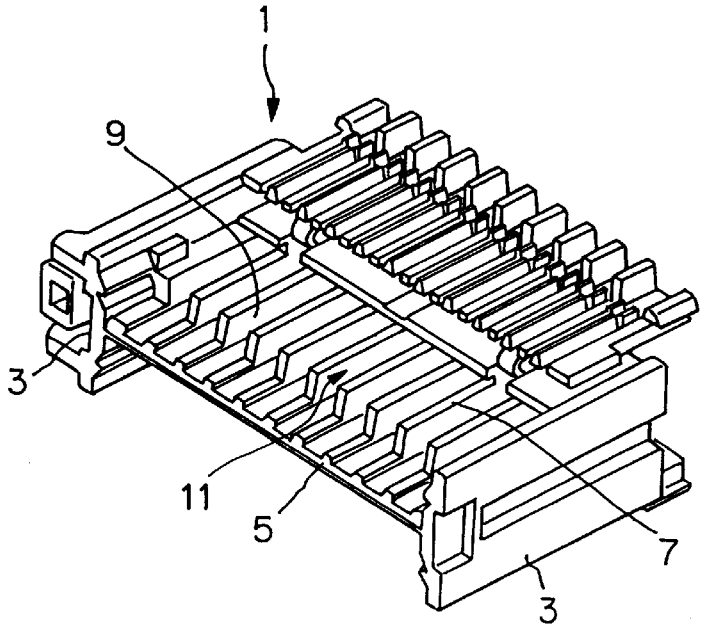
FIG. 3 PRIOR ART
FIG. 3 is a perspective view of a housing of a conventional press-connecting connector.
Figure 4:
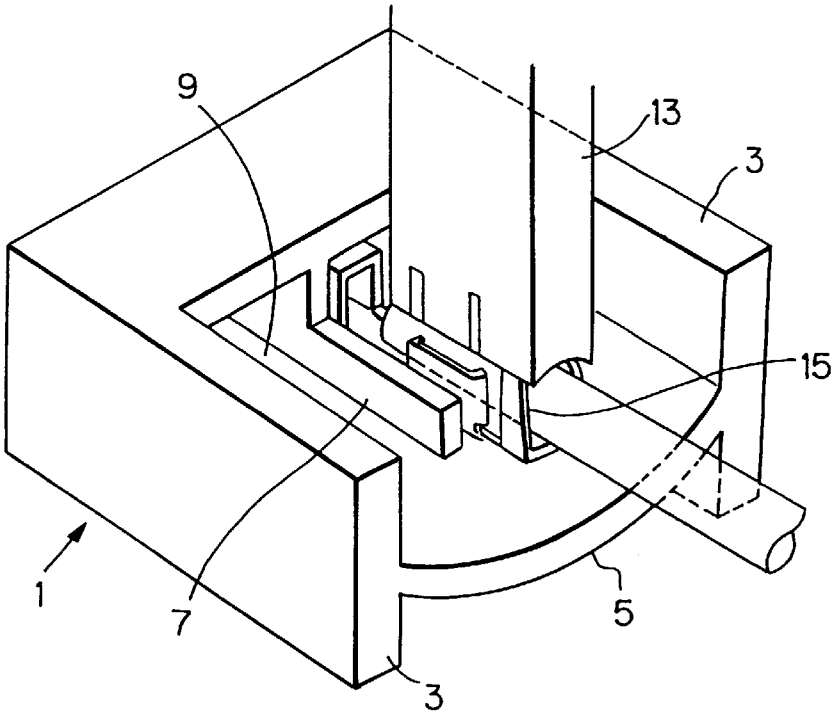
FIG. 4 PRIOR ART
FIG. 4 is a perspective view showing a state of a bottom plate portion when a wire is press-connected to a terminal mounted in the housing.

FIG. 1 is a perspective view showing a housing of the press-connecting connector of the invention, and FIG. 2 is a vertical cross-sectional view of the press-connecting connector of the invention having terminals mounted in the housing. The housing 21 includes a pair of side plate portions 23, a bottom plate portion 25 interconnecting the pair of side plate portions 23, and juxtaposed terminal receiving chambers 29 which are formed on each of upper and lower surfaces of the bottom plate portion 25, and are separated from one another by a plurality of parallel partition walls 27.

The housing 21 has an open portion 31 through which rear portions of the terminal receiving chambers 29 are exposed. A wire (not shown) is press-fitted through the open portion 31 into a terminal 33 (see FIG. 2), mounted in the terminal receiving chamber 29, by a jig or tool (not shown). A main portion of the bottom plate portion 25 except its rear end portion is defined by a reduced-thickness (smaller-thickness) portion 35 having a thickness $t_1$. The thickness $t_1$ of the reduced-thickness portion 35 can be smaller than the thickness of the conventional bottom plate portion which prevents the bottom plate portion from being deformed by the pressing force applied by the jig. The rear end portion of the bottom plate portion 25 is defined by a thickened (larger-thickness) portion 37 having a thickness $t_2$ larger than the thickness $t_1$ of the reduced-thickness portion 35. Namely, the bottom plate portion 25 is thickened only at its rear end portion to provide the thickened portion 37 appearing much like a beam. The reduced-thickness portion 35 is continuous with the thickened portion 37 through a step portion 39 to provide a mounting surface at each side of the bottom plate portion 25 which mounting surface bears the terminals 33. In this embodiment, the step portion 39 has a slanting surface.

On the other hand, the terminal 33 to be mounted in the terminal receiving chamber 29 includes an electric connection portion 41 at its front end, a press-connecting portion 43 disposed rearwardly of the electric connection portion 41, and a pair of clamping piece portions 47 which are disposed rearwardly of the press-connecting portion 43 and extend respectively from opposite-side edges of a base plate portion 45. The base plate portion 45 is bent between the press-connecting portion 43 and the clamping piece portions 47 to form a bent portion 49. When the terminal 33 is mounted in the associated terminal receiving chamber 29, the bent portion 49 is disposed parallel to the step portion 39, and hence conforms thereto. Namely, the terminal 33 is received in the terminal receiving chamber 29, with the electric connection portion 41 and the press-connecting portion 43 placed on the reduced-thickness portion 35, and with the clamping piece portions 47 placed on the thickened portion 37.

In the press-connecting connector 51 thus constructed, two rows of terminals 33 are mounted respectively at upper and lower portions of the housing 21 in such a manner that the reduced-thickness portion 35 of the bottom plate portion 25 is held between the electric connection portions 41 of the two rows of terminals 33 and also between the press-connecting portions 43 of the two rows of terminals 33, and a pitch P of the terminals 33 disposed respectively on the opposite sides of the bottom plate portion 25 is smaller as compared with the conventional construction. The strength of the bottom plate portion 25 is increased by the thickened portion 37 defining the rear end portion thereof, and a pressing force, applied by a jig when press-fitting a wire and also deforming the clamping piece portions 47, is borne by the thickened portion 37.

Further, in this embodiment, the clamping piece portions 47 of the terminals 33 are placed on the thickened portion 37, and therefore at least the pressing force, applied by the jig for deforming the clamping piece portions 47, is borne by the thickened portion 37, so that the pressing force, acting on the reduced-thickness portion 35, is reduced.

The clamping piece portions 47 of the two rows of terminals 33 are disposed respectively on the opposite sides of the thickened portion 37, and therefore before the clamping portions 47 of each terminal 33 are pressed by the jig, the clamping piece portions 47 project higher than the press-connecting portion 43. However, the clamping piece portions 47 are clamped around the wire, and become lower than the press-connecting portion 43, and therefore will not affect a reduced dimension of the housing 21 in the direction of the thickness of the bottom plate portion 25. In other words, in the press-connecting connector 51, one portion of the bottom plate portion 25 which does not affect the small-size design of the connector is thickened to increase the strength whereas the other portion of the bottom plate portion 25 which affects the small-size design is thinned.

In the above press-connecting connector 51, the main portion of the bottom plate portion 25 of the housing 21 is defined by the reduced-thickness portion 35, and the rear end portion, which does not affect the small-size design, is defined by the thickened portion 37. Therefore, the pitch P of the terminals 33 disposed respectively on the opposite sides of the bottom plate portion 25 is smaller, and the strength is secured by the thickened portion 37, and the load, applied by the jig, can be borne by the thickened portion 37. As a result, the reduced dimension of the housing 21 in the direction of the thickness-of the bottom plate portion 25, and the prevention of deformation of the housing 21 during the press-connecting operation can be achieved at the same time.

In the above embodiment, the clamping piece portions 47 of the terminals 33 are placed on the thickened portion 37, the pressing force, applied by the jig to the clamping piece portions 47 to clamp the same to the wire, is borne by the thickened portion 37, so that the pressing force, acting on the reduced-thickness portion 35, is reduced.

In the above embodiment, although the thickened portion 37 is formed at the rear end of the bottom plate portion 25, the thickened portion 37 may be formed at another portion of the bottom plate portion 25, depending on the configuration of the terminal 33.

Further, in the above embodiment, although the step portion 39 between the reduced-thickness portion 35 and the thickened portion 37 is interconnected by the slanting surface defining the step portion 39, the step portion 39 may have a vertical surface perpendicular to the bottom plate portion 25. In this case, the bent portion 49 of the terminal 33 can have a vertical surface conforming to the step portion 39, and with this arrangement the two vertical surfaces, respectively defining the step portion 39 of the housing 21 and the bent portion 49 of the terminal 33, abut against each other, thereby increasing the force of holding the terminal 33 against a wire pulling force.

As described above in detail, the main portion of the bottom plate portion 25 is defined by the reduced-thickness portion 35, and the rear end portion, which does not affect the small-size design, is defined by the thickened portion 37. Therefore, the pitch P of the terminals 33 disposed respectively on the opposite sides of the bottom plate portion 25 is smaller, and the increased strength of the bottom plate portion 25 is secured by the thickened portion 37, and the load, applied by the jig, can be borne by this thickened portion 37. As a result, the reduced dimension of the housing 21 in the direction of the thickness of the bottom plate portion 25, and the prevention of deformation of the housing 21 during the press-connecting operation can be achieved at the same time.

What is claimed is:

1. A press-connecting connector comprising:

a housing;

a terminal receiving chamber formed in said housing and having a bottom plate; and a terminal, mounted in said terminal receiving chamber and supported by said bottom plate, to which a wire is to be press-connected, said terminal including an electric connection portion, a press-connecting portion and a clamping piece portion.

wherein one portion of said bottom plate is a reduced-thickness portion, and another portion of said bottom plate is a thickened portion larger in thickness than said reduced-thickness portion, and wherein said reduced-thickness portion of said bottom plate supports said electric connection portion and said press-connecting portion, and said thickened portion of said bottom plate supports said clamping piece portion.

2. The press-connecting connector according to claim 1, wherein said reduced-thickness portion is connected to said thickened portion by a step portion, and said terminal includes a base plate, said base plate supporting said press-connecting portion and said clamping piece portion which are separated by a bent portion of said base plate, said bent portion being shaped to conform with said step portion.

3. The press-connecting connector according to claim 1, wherein a plurality of terminals are arranged respectively on upper and lower surfaces of said bottom plate.

4. A press-connecting connector comprising:

a housing;

a terminal receiving chamber formed in said housing and having a bottom plate; and a terminal, mounted in said terminal receiving chamber and supported by said bottom plate, to which a wire is to be press-connected, said terminal including a press-connecting portion and a clamping piece portion, wherein one portion of said bottom plate is a reduced-thickness portion, and another portion of said bottom plate is a thickened portion larger in thickness than said reduced-thickness portion, and wherein said reduced-thickness portion is connected to said thickened portion by a step portion, and said terminal includes a base plate, said base plate supporting said press-connecting portion and said clamping piece portion which are separated by a bent portion of said base plate, said bent portion being shaped to conform with said step portion.

* * * * *